US005773770A

United States Patent [19]

Jones

[11] Patent Number: 5,773,770

[45] Date of Patent: Jun. 30, 1998

[54] CROSS FLOW PATH EXHAUST MUFFLER

[76] Inventor: Mack L. Jones, M.A.C. Products, Inc., 43214 Black Deer Loop, Unit 113, Temecula, Calif. 92590-3473

[21] Appl. No.: 872,814

[22] Filed: Jun. 11, 1997

[51] Int. Cl.[6] ..... F01N 1/08

[52] U.S. Cl. ..... 181/268; 181/273; 181/275; 181/276; 181/239

[58] Field of Search ..... 181/238, 239, 181/240, 264, 268, 272, 275, 276, 273

[56] References Cited

U.S. PATENT DOCUMENTS

| | | | |
|---|---|---|---|
| 2,985,252 | 5/1961 | Morrish et al. | 181/239 |
| 3,642,093 | 2/1972 | Schach | 181/239 |
| 4,574,914 | 3/1986 | Flugger | 181/268 |
| 4,809,812 | 3/1989 | Flugger | 181/268 |

*Primary Examiner*—Khanh Dang
*Attorney, Agent, or Firm*—Loyal McKinley Hanson

[57] ABSTRACT

An exhaust muffler includes a housing having a rectangularly shaped hollow interior without fiberglass or other packing. An inlet tube and a first outlet tube extend through one side wall of the housing, and a second outlet tube extends through an opposite side wall. The inlet tube extends to an inner end disposed at a central region of the interior in a position facing away from a forward end wall of the housing toward an opposite rearward end wall, while a baffle assembly within the interior includes perforated partitions that define two Helmholtz chambers, as well as a first passageway from the inner end of the inlet tube to the first outlet tube and a second passageway from the inner end of the inlet tube to the second outlet tube. The baffle assembly includes first and second plates disposed within the first and second passageways to split the flow of exhaust gases.

2 Claims, 3 Drawing Sheets

FIG. 2
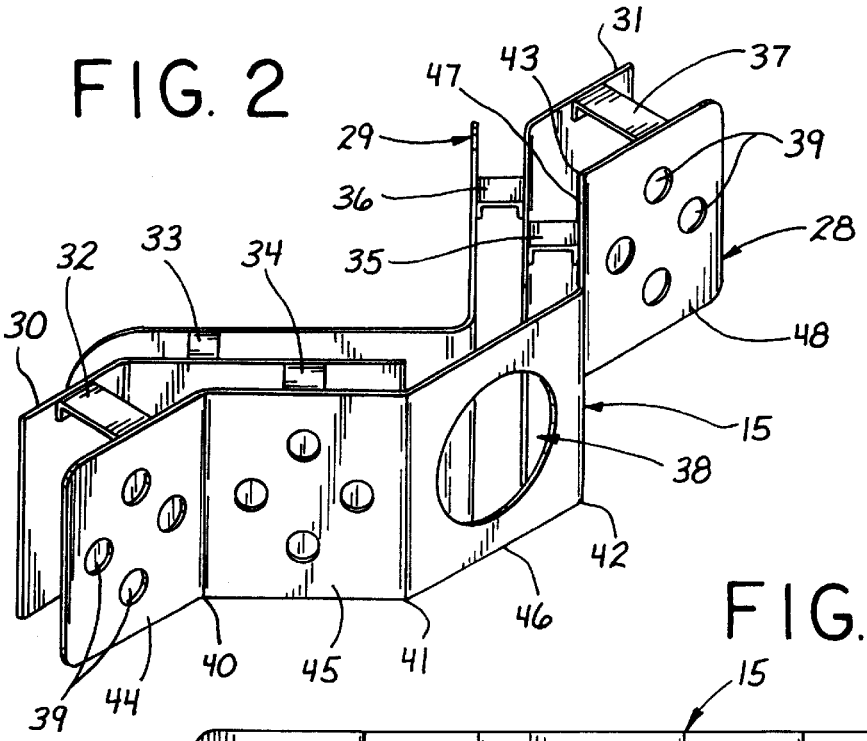
FIG. 3
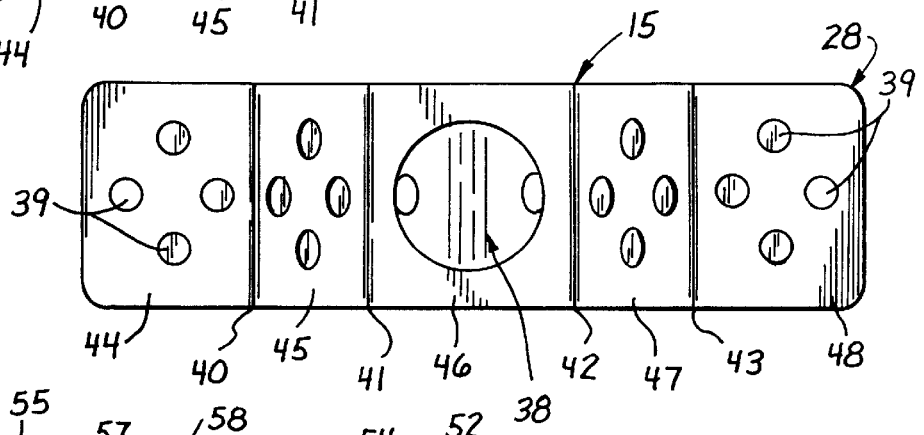
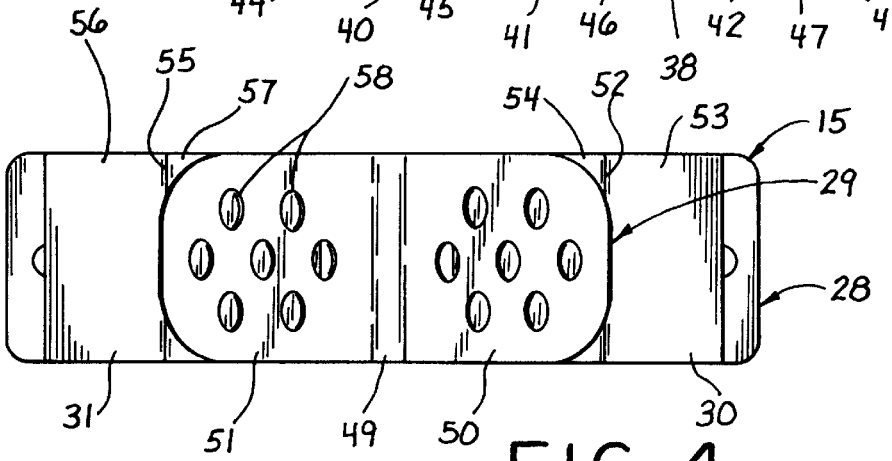
FIG. 4

CROSS FLOW PATH EXHAUST MUFFLER

BACKGROUND OF THE INVENTION

1. Technical Field

This invention relates generally to exhaust mufflers for internal combustion engines, and more particularly to an exhaust muffler that provides better sound attenuation without significantly degrading engine performance.

2. Description of Related Art

Many exhaust mufflers are the type that includes some sort of baffle structure within an enclosure. The enclosure is commonly referred to as a muffler housing, and it includes an inlet and an outlet. Exhaust from a header pipe connected to the engine enters through the inlet, passes through and/or past the baffle structure, and then exits through the outlet to the tailpipe. As that occurs, accompanying sound is attenuated through restriction, reflection, and/or absorption.

Although existing muffler designs are effective in many respects, muffler-produced back pressure can be a problem. It tends to degrade engine performance, especially in high-performance racing cars. As a result, automotive designers, manufacturers, and users seek mufflers with improved sound-attenuation versus back-pressure characteristics, coupled with other desirable features of being compact, lightweight, and cost effective.

SUMMARY OF THE INVENTION

This invention addresses the need outlined above by providing an exhaust muffler having a single inlet, two outlets, and a baffle assembly that directs the flow of exhaust gases from the inlet to the outlets along two main passageways or "flow paths." A splitter/reflector plate along each of the flow paths combines with multiple Helmholtz chambers to produce improved noise reduction with significantly less backpressure. Sound energy is reflected to control noise while allowing exhaust gases to flow freely through large dual flow paths. By redirecting and causing lo sound waves to collide, high-frequency sound is reduced without obstructing flow.

To paraphrase some of the claim language that is subsequently presented, an exhaust muffler constructed according to the invention includes a housing having opposite top and bottom walls, opposite first and second side walls, and opposite forward and rearward end walls that enclose a hollow interior of the housing. Means are provided in the form of an inlet tube for conveying exhaust gases into the housing, and means are provided in the form of first and second outlet tubes for conveying exhaust gases out of the housing. In addition, a baffle assembly within the housing for defines multiple paths for exhaust gases to follow and multiple Helmholtz chambers for the exhaust gases to encounter as the exhaust gases flow through the housing from the inlet tube to the first and second outlet tubes.

The inlet tube extends through the first side wall to an inner end of the inlet tube. The inner end is disposed at a central region of the interior in a position facing the rearward end wall. The first outlet tube also extends through the first side wall, while the second outlet tube extends through the second side wall.

The baffle assembly includes first and second partitions extending between the top and bottom walls of the housing that define first and second Helmholtz chambers, as well as a first passageway from the inner end of the inlet tube to the first outlet tube and a second passageway from the inner end of the inlet tube to the second outlet tube. The baffle assembly also includes means for splitting the flow of exhaust gases in the first and second passageways, including a first plate extending along the first passageway intermediate the inner end of the inlet tube and the first outlet tube and a second plate extending along the second passageway intermediate the inner end of the inlet tube and the second outlet tube.

The following illustrative drawings and detailed description make the foregoing and other objects, features, and advantages of the invention more apparent.

BRIEF DESCRIPTION OF THE DRAWINGS

FIG. 2 is a perspective view of just the baffle assembly;

FIG. 3 is a front view of the baffle assembly;

FIG. 4 is a back view of the baffle assembly; and

DESCRIPTION OF THE PREFERRED EMBODIMENTS

Figure 1:
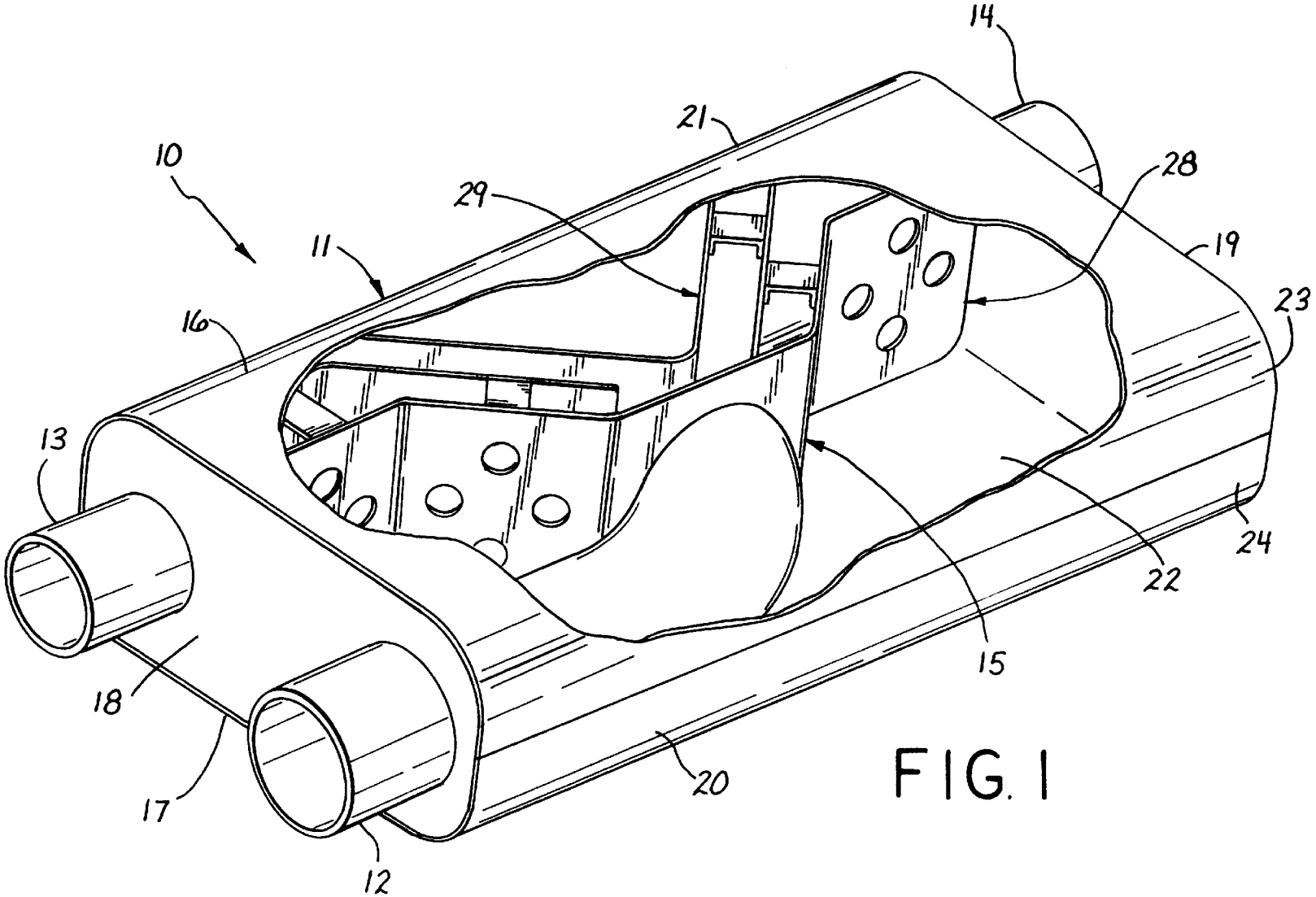
FIG. 1 of the drawings is a perspective view of an exhaust muffler constructed according to the invention, with portions of the housing broken away to reveal the baffle assembly within.
Figure 5:
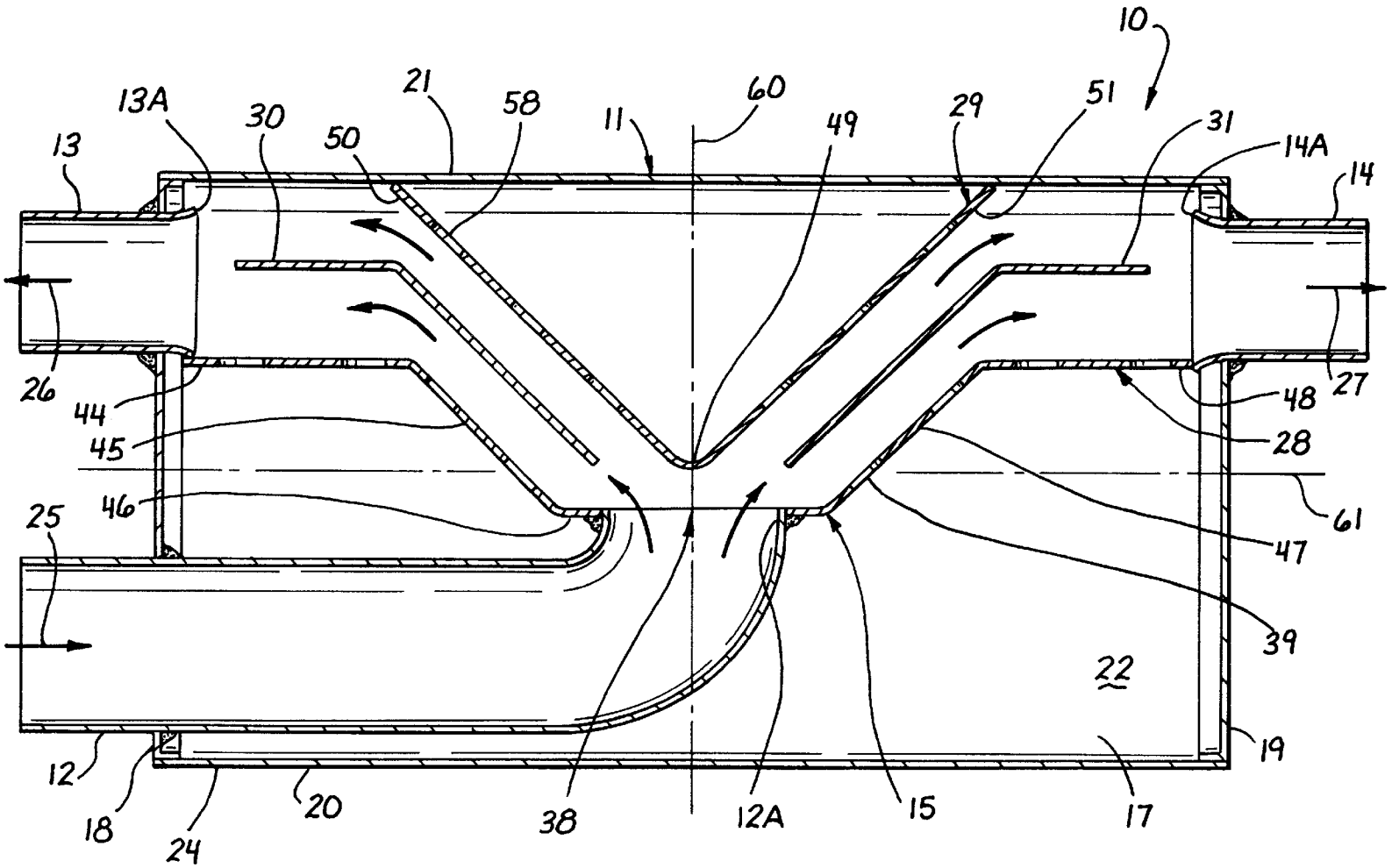
FIG. 5 is a diagrammatic top view of the exhaust muffler showing the various flow paths past the baffle assembly within the housing.

The drawings show an exhaust muffler 10 constructed according to the invention. Generally, the muffler 10 includes a housing 11, a 3-inch inside diameter inlet tube 12, first and second 2½-inch inside diameter outlet tubes 13 and 14, and a baffle assembly 15 (FIGS. 1 and 5). Components are constructed of 1.2-mm thick AK metal (steel with 8 percent aluminum) that is given a high-temperature coating (HTS). The inlet and outlet tubes 12–14 and the baffle assembly 15 are welded to the housing 11, and the housing components are welded together to form an air-tight enclosure.

The housing 11 includes parallel top and bottom walls 16 and 17, parallel first and second side walls 18 and 19, and parallel forward and rearward end walls 20 and 21. Together, the six walls 16–21 define an interior 22 of the housing 11. A top half 23 of the housing 11 designated in FIG. 1 (a U-shaped component forming the top wall 16, a portion of the forward end wall 20, and a portion of the rearward end wall 21) is welded to a mating U-shaped bottom half 24 of the housing 11 after the first and second side walls 18 and 19 and the baffle assembly 15 are welded to the bottom half 24.

As an idea of size, the illustrated housing 11 is about 18 inches long, 10 inches wide, and 4 inches high. Corresponding dimensions of the interior 22 are two wall thicknesses less. Of course, one of ordinary skill in the art can vary those dimensions without departing from the scope of the claims in order to size the muffler for a particular application.

In terms of function, the inlet tube 12 functions as means for conveying exhaust gases (e.g., from a header pipe or other external upstream component) into the housing 11, and it extends through the first side wall 18 into the interior 22 of the housing 11 (i.e., through a first opening in the first side wall). The first and second outlet tubes 13 is and 14 function as first and second means for conveying exhaust gases out of the housing 11 (e.g., to a tailpipe or other external downstream component), and they extend through respective ones of the first and second side walls 18 and 19 (i.e., through a first opening in the second side wall and a first opening in the second side wall). The baffle assembly 15 functions as means for defining multiple paths for exhaust gases to follow and multiple Helmholtz chambers for the exhaust gases to encounter as the exhaust gases flow through the housing 11 from the inlet tube 12 to the first and second outlet tubes 13 and 14. Exhaust gases entering the housing 11 through the inlet tube 12 as depicted by an arrow 25 in FIG. 5, flow through the interior 22 (along multiple paths subsequently described) and out of the outlet tubes 13 and 14 as depicted by arrows 26 and 27 in FIG. 5.

FIGS. 2–4 show further details of the baffle assembly 15. It includes first and second perforated partitions 28 and 29 and first and second splitter plates 30 and 31 that are joined together in spaced apart relation with tabs welded to them (e.g., the tabs 32–36 in FIG. 2). The partitions 28 and 29 and the plates 30 and 31 are formed from sheets of metal dimensioned to extend between the top and bottom walls 16 and 17 of the housing 11 and to within extend the interior 22 of the housing 11 as will be described later on with reference to FIG. 5.

Muffler design can be somewhat empirical in many respects, and it is found that the perforated partition design and placement described herein provide significantly improved performance. The partition 28 includes a 3-inch diameter opening 38, sixteen 0.75-inch diameter openings 39, and four 45-degree bends 40–43 that result in five sections or panels 44–48 of the partition 28 (FIGS. 2 and 3). As will be described further on, the inlet tube 12 conveys exhaust gases to the opening 38 and the openings 39 communicate with a first of two Helmholtz chambers. Only four of the openings 39 are designated in FIGS. 2 and 3 in order to keep the drawings uncluttered.

Similarly, the partition 29 includes a 90-degree bend 49 that results in two panels 50 and 51 of the partition 29 (FIG. 4). In addition, the first splitter plate 30 includes a 45-degree bend 52 that results in two panels 53 and 54 of the first splitter plate (FIG. 4), and the second splitter plate 31 includes a 45-degree bend 55 that results in two panels 56 and 57 of the second splitter plate (FIG. 4). Fourteen 0.75-inch diameter openings 58 in the partition 29 communicate with a second Helmholtz chamber to be described later on. Only two of the openings 58 are designated in FIG. 4 for illustrative convenience.

After the baffle assembly 15 is assembled, it is welded or otherwise suitable secured to the bottom half 24 of the housing 11. With the baffle assembly 15 in place, the top half 23 of the housing 11 is welded or otherwise suitable secured onto the bottom half 24 to form an air-tight enclosure. Preferably, the top half 23 is provided with holes at appropriate places to enable the manufacturer to weld the baffle assembly 15 to the top half 23 of the housing 11 also. From the preceding and subsequent descriptions, one of ordinary skill in the art can use different fabrication techniques to construct a muffler within the scope of the claims.

FIG. 5 is a top view of the muffler 10 with the top half 23 removed in order to show the multiple paths the exhaust gases follow and multiple Helmholtz chambers the exhaust gases encounter as they flow through the interior 22 of the housing 11, from the inlet tube 12 through the interior 22 of the housing 11 to the outlet tubes 13 and 14. The baffle components within the housing 11 are in cross section in FIG. 5, taken in a lateral plane parallel to the bottom wall 17 in order to expose important features.

To facilitate the description of component placement within the housing 11, and the various flow paths and Helmholtz chambers, the interior 22 of the housing 11 is described as including four quarters. They are bounded by a longitudinally bisecting plane 60 (depicted by a phantom line in FIG. 5) and a transversely bisecting plane 61 (also depicted by a phantom line). The plane 60 which extends longitudinally through the housing 11 perpendicular to the bottom wall 16 and midway between and parallel to the first and second side walls 18 and 19. The plane 61 extends transversely through the housing 11 perpendicular to the plane 60 and midway between the forward and rearward end walls 20 and 21.

With the planes 60 and 61 so defined, the first quarter of the interior 22 is bounded by the planes 60 and 61, the first side wall 18, and the forward end 20. The second quarter of the interior 22 is bounded by the planes 60 and 61, the second side wall 19, and the forward end wall 20. The third quarter is bounded by the planes 60 and 61, the first side wall 18. The rearward end wall 21, and the fourth quarter is bounded by the planes 60 and 61, the second side wall 19 and the rearward end wall 21, and the baffle assembly 15 is symmetrical with respect to the plane 60. To further facilitate description, the interior 22 is described as including a central region proximate the intersection of the planes 60 and 61.

Using the above definitions, the inlet tube 12 extends through the first side wall 18 and the first quarter of the interior 22 to an inner end 12A of the inlet tube 12 that is disposed at the central region of the interior 22. A 90-degree bend in the inlet tube 12 results in the inner end 12A facing away from the forward end wall 20 toward the rearward end wall 21. The inner end 12A of the inlet tube 12 is welded to the panel 46 of the partition 28 so that the inlet tube 12 is in fluid communication with the opening 38.

Continuing to use the above definitions, the panel 50 of the partition 29 angles within the third quarter of the interior 22 from the rearward end wall to the bend 49 (proximate the intersection of the planes 60 and 61), while the panel 51 of the partition 29 angles within the fourth quarter from the rearward end wall 21 to the bend 49. That arrangement results in first and second passageways between the partitions 28 and 29. The first passageway extends from the inner end 12A of the inlet tube 12 at the opening 38 to the first outlet tube 13, and the second passageway extends from the inner end 12A of the inlet tube 12 at the opening 38 to the second outlet tube 14.

The above-stated arrangement of the partitions 28 and 29 also results in first and second Helmholtz chambers within the interior 22. The first Helmholtz chamber occupies part of the first, second, third, and fourth quarters of the interior 22, being bounded by the partition 28, the first and second side walls 18 and 19, and the forward end wall 20, while the second Helmholtz chamber occupies part of the third and fourth quarters of the interior 22, being bounded by the partition 29 and the rearward end wall 21. The openings 39 in the partition 28 provide fluid communication between the first Helmholtz chamber and the first and second passageways, while the openings 58 in the partition 29 provide fluid communication between the second Helmholtz chamber and the first and second passageways. Only one of the sixteen openings 39 and only of the fourteen openings 58 are designated in FIG. 5 for illustrative convenience, to keep that figure less cluttered.

In addition to the foregoing, the baffle assembly 15 includes means for splitting the flow of exhaust gases in the first and second passageways. That function is accomplished by the first and second splitter plates 30 and 31. The splitter plate 30 extends along the first passageway intermediate the inner end 12A of the inlet tube 12 at the opening 38 and an inner end 13A of the first outlet tube 13 to split the flow of exhaust gases in the first passageway. The splitter plate 31 extends along the second passageway intermediate the inner end 12A of the inlet tube 12 at the opening 38 and an inner end 14A of the second outlet tube 14 to split the flow of exhaust gases in the second passageway.

Exhaust gases flowing through the inlet tube 12 as depicted by the arrow 25 in FIG. 5, pass through the opening 38 as depicted by the two arrows through the opening 38 in FIG. 5. Some of the exhaust gases flow along the first passageway from the opening 38 to the first outlet tube 13 on both sides of the splitter plate 30, as depicted by the two arrows on either side of the splitter plate 30 in FIG. 5, and then through the first outlet tube 13 as depicted by the arrow 26. Some of the exhaust gases flow along the second passageway from the opening 38 to the second outlet tube 14 on both sides of the splitter plate 31, as depicted by the two arrows on either side of the splitter plate 31 in FIG. 5, and then through the second outlet tube 14 as depicted by the arrow 27. As that occurs, the exhaust gases encounter the first and second Helmholtz chambers by virtue of the openings 39 in the partition 28 and the openings 58 in the partition 29.

The two passageways, the split paths along each passageway, and the multiple Helmholtz chambers combine to produce improved noise reduction with significantly less backpressure. Sound energy is reflected to control noise while allowing exhaust gases to flow freely through large dual flow paths. By redirecting and causing sound waves to collide, high-frequency sound is reduced without obstructing flow. Although an exemplary embodiment has been shown and described, one of ordinary skill in the art may make many changes, modifications, and substitutions without necessarily departing from the spirit and scope of the invention.

What is claimed is:

1. An exhaust muffler, comprising;

a housing, the housing having opposite top and bottom walls, opposite first and second side walls, and opposite forward and rearward end walls that enclose a hollow interior of the housing;

means in the form of an inlet tube for conveying exhaust gases into the housing;

means in the form of first and second outlet tubes for conveying exhaust gases out of the housing; and means in the form of a baffle assembly within the housing for defining multiple paths for exhaust gases to follow and multiple Helmholtz chambers for the exhaust gases to encounter as the exhaust gases flow through the housing from the inlet tube to the first and second outlet tubes;

wherein the inlet tube extends through the first side wall to an inner end of the inlet tube that is disposed at a central region of the interior in a position facing away from the forward end wall toward the rearward end wall, the first outlet tube extends through the first side wall, and the second outlet tube extends through the second side wall;

wherein the baffle assembly includes first and second partitions extending between the top and bottom walls of the housing that define first and second Helmholtz chambers, a first passageway from the inner end of the inlet tube to the first outlet tube, and a second passageway from the inner end of the inlet tube to the second outlet tube; and wherein the baffle assembly includes means for splitting the flow of exhaust gases in the first and second passageways, including a first plate extending along the first passageway intermediate the inner end of the inlet tube and the first outlet tube and a second plate extending along the second passageway intermediate the inner end of the inlet tube and the second outlet tube.

2. An exhaust muffler, comprising;

a housing, the housing having opposite top and bottom walls, opposite first and second side walls, and opposite forward and rearward end walls that enclose a hollow interior of the housing;

means in the form of an inlet tube for conveying exhaust gases into the housing;

means in the form of first and second outlet tubes for conveying exhaust gases out of the housing; and means in the form of a baffle assembly within the housing for defining multiple paths for exhaust gases to follow and multiple Helmholtz chambers for the exhaust gases to encounter as the exhaust gases flow through the housing from the inlet tube to the first and second outlet tubes;

wherein the interior of the housing includes first, second, third and fourth quarters bounded by a longitudinally bisecting plane and a transversely bisecting plane that intersect at a central region of the interior, the longitudinally bisecting plane extending through the housing midway between the first and second side walls perpendicular to the bottom wall, and the transversely bisecting plane extending through the housing midway between the forward and rearward end walls perpendicular to the longitudinally bisecting plane such that (i) the first quarter of the interior is bounded by said bisecting planes, the forward end wall, and the first side wall, (ii) the second quarter of the interior is bounded by said bisecting planes, the forward end wall, and the second side wall, (iii) the third quarter of the interior is bounded by said bisecting planes, the rearward end wall, and the first side wall, and (iv) the fourth quarter of the interior is bounded by said bisecting planes, the rearward end wall, and the second side wall;

wherein the first outlet tube extends through the first side wall into the third quarter, the second outlet tube extends through the second side wall into the fourth quarter, and the inlet tube extends through the first side wall into the first quarter to an inner end of the inlet tube that is disposed at the central region of the interior in a position facing away from the forward end wall toward the rearward end wall;

wherein the baffle assembly includes first and second perforated partitions extending between the top and bottom walls of the housing that define first and second Helmholtz chambers, a first passageway from the inner end of the inlet tube to the first outlet tube, and a second passageway from the inner end of the inlet tube to the second outlet tube, the first perforated partition extending within the third quarter of the interior from the first side wall at the first outlet tube to the inner end of the inlet tube and then within the fourth quarter to the second side wall at the second outlet tube, and the second perforated partition extending within the third quarter of the interior from the rearward end wall proximate the first outlet tube to the central region of the interior and then through the fourth quarter to the rearward end wall proximate the second outlet tube; and wherein the baffle assembly includes means for splitting the flow of exhaust gases in the first and second passageways, including a first plate extending along the first passageway intermediate the inner end of the inlet tube and the first outlet tube and a second plate extending along the second passageway intermediate the inner end of the inlet tube and the second outlet tube.

* * * * *